US005326061A

United States Patent [19]

Hamilton

[11] Patent Number: 5,326,061

[45] Date of Patent: Jul. 5, 1994

[54] SHELF MOUNTING MEANS

[76] Inventor: Glen R. Hamilton, Box 39, Eubank, Ky. 42567

[21] Appl. No.: 29,712

[22] Filed: Mar. 11, 1993

Related U.S. Application Data

[63] Continuation of Ser. No. 921,075, Jul. 29, 1992, abandoned, which is a continuation-in-part of Ser. No. 786,548, Nov. 1, 1991, abandoned.

[51] Int. Cl.[5] ..... A47G 29/02

[52] U.S. Cl. ..... 248/239; 248/235

[58] Field of Search ..... 248/235, 250, 239, 222.4; 40/152.1

[56] References Cited

U.S. PATENT DOCUMENTS 3,580,535 5/1971 Naske ..... 248/239

*Primary Examiner*—Blair M. Johnson

*Attorney, Agent, or Firm*—Charles J. Brown

[57] ABSTRACT

Bushings anchored in cavities in the rear edge of a shelf to allow the shelf to be mounted horizontally flush against a wall with the bushings concealed, wherein screw heads projecting from the wall fit into seats in the bushings which resist straight-line horizontal displacement of the bushings from the screw heads but allow removal by lifting of the shelf so that the screw heads are released from the seats, and wherein a glue-filled annular groove or backwardly bent fins are formed on the exterior of the bushing to anchor the bushing in the cavity.

1 Claim, 2 Drawing Sheets

SHELF MOUNTING MEANS

CROSS REFERENCE TO RELATED APPLICATIONS

This application is a continuation of my co-pending application entitled "Shelf Mounting Means" filed July 29, 1992 and given Ser. No. 07/921,075, which in turn is a continuation-in-part of my parent application entitled "Shelf Mounting Means" filed Nov. 1, 1991 and given Ser. No. 07/786,548, both abandoned.

BACKGROUND OF THE INVENTION

Brackets for securing shelves horizontally to a wall are well known in the prior art, as for example those described in U.S. Pat. Nos. 4,299,367 and 4,871,136. No conventional shelf bracket or mounting means has been available, however, in which the rear edge of the shelf can be mounted flush against the wall with the mounting means totally concealed and with the shelf readily removable simply by lifting and withdrawing it away from the wall.

Various forms of mounting means are disclosed in U.S. Pat. No. 4,460,146 which allow a bracket secured to a shelf to fit over and behind the head of a screw projecting from the wall but in that disclosure the bracket is either interposed between the shelf and the wall to prevent the shelf from being mounted flush against the wall or the bracket is quite visible on the underside of the shelf or in the angle between the shelf and the wall. In U.S. Pat. No. 4,398,691 a wall bracket is disclosed in which a deformable annulus around the head of a screw projecting from a wall is inserted into a cavity in the rear edge of the shelf. However, an elastic hook on that annulus is snapped into a step in the cavity and cannot be released from the shelf without the use of a special tool.

The principal object of the present invention is to provide shelf mounting means which are totally concealed when the shelf is mounted, which allow the shelf to be mounted flush against the wall surface and which permit easy removal simply by lifting the shelf and then displacing it horizontally away from the wall. U.S. Pat. Nos. 3,487,446 and 3,580,535 disclose mounting bushings which are of a structure and function distinguishable from the shelf mounting means of the invention but in some respects generally related thereto.

SUMMARY OF THE INVENTION

The mounting means of the invention for releasably securing a shelf horizontally to a wall comprises a bushing having an outer configuration permitting it to be received fully and in a close fit within a cavity in a rear edge of the shelf. Means are provided on the exterior of the bushing for anchoring the bushing in the cavity. A screw is provided having a head and shank portion adapted to project substantially horizontally from the wall. A seat end is included in the bushing adapted to fit over and behind an upper edge portion of the head projecting from the wall thereby resisting straight line horizontal displacement of the bushing from the screw head and therefore of the shelf from the wall. By this construction the rear edge of the shelf may be mounted flush against the wall with the bushing concealed and the shelf may be removed by lifting the bushing from the screw head and horizontally displacing the shelf away from the wall.

In one form of the invention the means for anchoring the bushing in the cavity is an indentation formed on the exterior of the bushing to receive glue. In another preferred form of the invention the means for anchoring the bushing in the cavity are a plurality of protruding fins which bend backwardly as the bushing is inserted in the cavity. Preferably the fins protrude from opposite sides of the bushing. The screw head and shank may be of circular cross section and the seat end includes an arcuate recess for receiving the edge portion of the screw head and an arcuate lip adapted to fit over and behind the head portion and partially around the shank. The outer configuration of the bushing may be cylindrical and the indentation for receiving glue is then an annular groove encircling the exterior of the bushing.

DESCRIPTION OF PREFERRED EMBODIMENT

Figure 1:
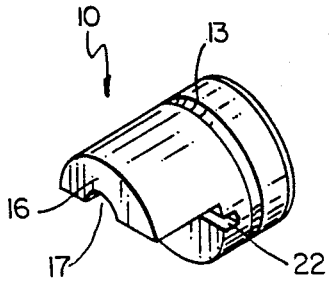
FIG. 1 is a perspective view of one form of the bushing of the invention.
Figure 2:
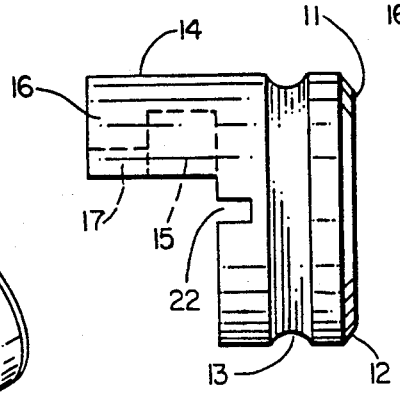
FIG. 2 is a side elevation of the bushing of FIG. 1.

Referring first to the embodiment of FIGS. 1 through 5 the bushing 10 of the invention may be of metal or plastic but in many cases plastic will be preferred. The bushing 10 is of one piece and is generally cylindrical with a flat inner end 11 having a chamfered periphery 12 for ease of insertion as described below. Encircling the body of the bushing 10 is an annular groove 13 for receiving glue as hereinafter described. Opposite the inner end 11 of the bushing 10 is a seat end 14 which comprises an arcuate recess 15 and an arcuate lip 16 defining its own smaller arcuate recess 17.

Figure 5:
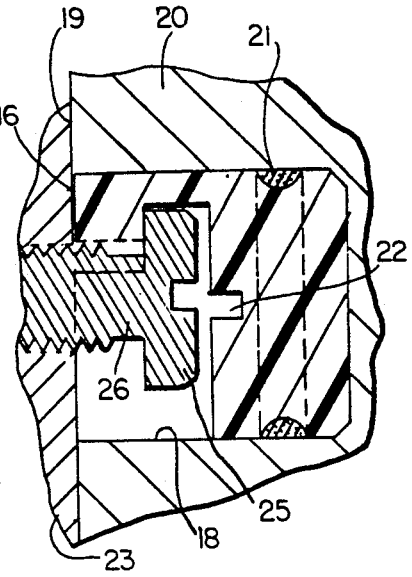
FIG. 5 is a vertical section of the bushing of FIG. 1 in place in a cavity in the rear edge of a shelf with the shelf mounted against a wall.
Figure 3:
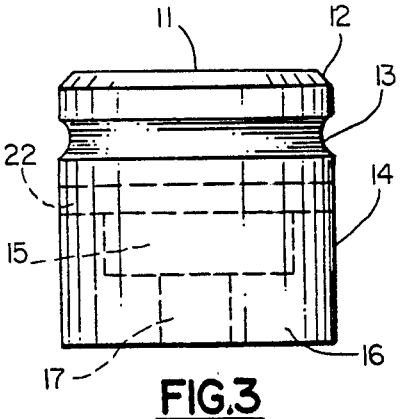
FIG. 3 is a top plan view of the bushing of FIG. 1.
Figure 4:
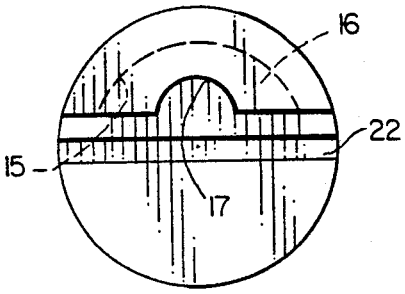
FIG. 4 is an end view of the bushing of FIG. 1.
Figure 7:
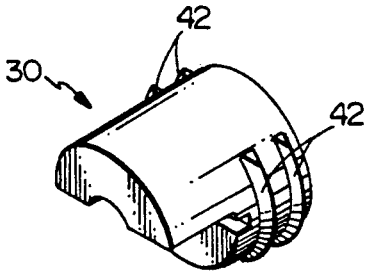
FIG. 7 is a perspective view of another form of the bushing of the invention.
Figure 8:
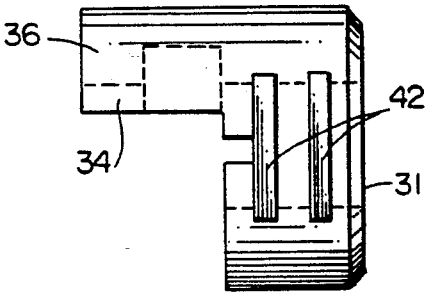
FIG. 8 is a side elevation of the bushing of FIG. 7.
Figure 9:
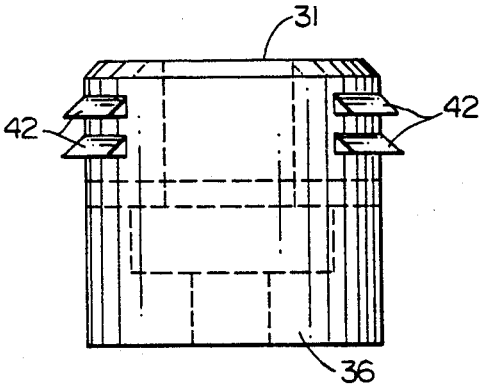
FIG. 9 is a top plan view of the bushing of FIG. 7.

The bushing 10 has an outer configuration permitting it to be received fully and in a close fit within a cylindrical cavity 18 formed in a rear edge 19 of a shelf 20 as shown in FIG. 5. To anchor the bushing 10 in the cavity 18 a deposit of glue is excessively applied around the annular groove 13 before the bushing is inserted in the cavity. The glue should be chosen to bond both with the plastic of the bushing 10 and the material of the shelf 20 which may typically be of wood. Upon setting and hardening of a bead 21 of the glue a mechanical interlock is formed by the hardened bead since it projects into the groove 13 and also is bonded to the close fitting wall of the cavity 18. Care should be taken during insertion and anchoring of the bushing 10 in the cavity 18 to insure that the seat end 14 is at the "twelve o'clock position" as shown in FIG. 4. For that purpose a screwdriver slot 22 may be provided across the center of the exposed inner end 11 of the bushing 10 to permit final rotation of the bushing 10 to its desired position before the bead 21 of glue sets and makes rotation of the inserted bushing 10 impossible.

A plurality of such bushings 10 may be inserted in a corresponding plurality of cavities 18 on the rear edge 19 of the shelf 20, and a corresponding plurality of screws 23 are then mounted in a wall 24 in a horizontal line positioned to register with the respective cavities 18 on the rear edge 19 of the shelf 20.

The components of the seat end 14 on each bushing 10 are sized and positioned such that a circular head 25 of each screw 23 fits snugly within the arcuate recess 15 and the arcuate lip 16 then fits over and behind the head 25 and partially about a shank 26 of the screw 23 as shown particularly in FIG. 5. The shank 26 is received within the partially encircling arcuate recess 17. By this interaction of the seat end 14 of the bushing 10 with the screw head 25 the seat end resists straight line horizontal displacement of the bushing from the screw head 25 and therefore of the shelf 20 from the wall 24.

Figure 6:
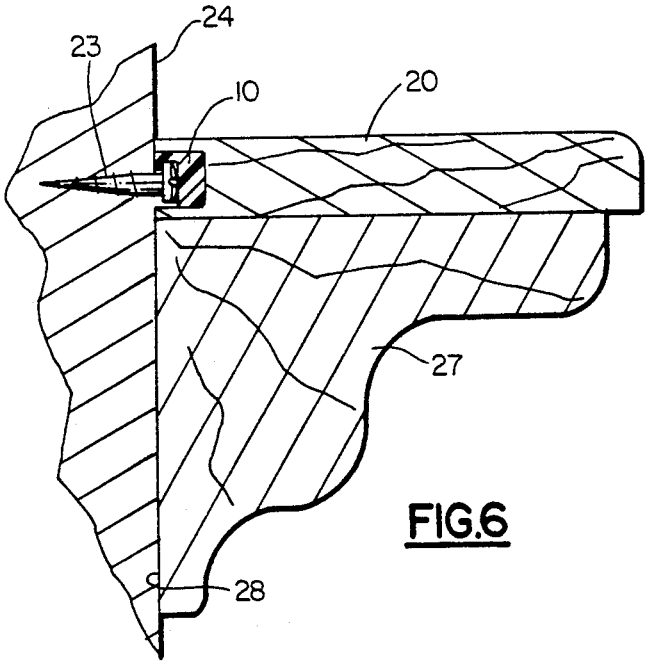
FIG. 6 is a section illustrating the shelf mounted on the wall with an appropriate bracket included.

It will normally be appropriate to affix a support such as some kind of bracket 27 to the underside of the shelf 20 as shown in FIG. 6. The bracket 27 may have a vertical surface 28 adapted to abut the wall 24 to hold the mounted shelf 20 in a horizontal plane.

By this construction each bushing 10 is readily anchored in its associated cavity 18 as a consequence of the bead 21 of glue in the groove 13 as described above. In that position each bushing 10 is entirely concealed. The rear edge 19 of the shelf 20 is then mounted flush against the wall 24. The shelf 20 may be readily removed simply by lifting its rear edge 19 so that the lip 16 of each bushing 10 is elevated from the associated screw head 25 to allow the shelf to be horizontally displaced away from the wall 24.

Referring now to FIGS. 7 through 11 another form of the invention is disclosed with preferred means for anchoring the bushing in the cavity. A bushing 30 is of plastic in this embodiment and again is generally cylindrical with a flat inner end 31 having a chamfered periphery 32 as in the prior embodiment and a seat end 33 with an arcuate recess 34 and lip 36 as in the prior embodiment. For simplification in extrusion of the bushing 30, a bore 38 extends entirely through the inner end 31 of the bushing 30 as seen particularly in FIG. 11.

The principal difference between this embodiment of the invention and that described in FIGS. 1 to 6 is that no glue-receiving annular groove is provided such as the groove 13 but instead a plurality of somewhat flexible integral plastic fins 40–40A and 41–41A extend from the body of the plastic bushing 30. As shown in this example a pair of such fins are located opposite one another on each side of the body of the bushing 30 but if desired there may be three or more such fins on each side. Each fin 40 is arcuate in shape and has a bevelled edge protruding about one-sixteenth of an inch from the body of the bushing.

Figure 11:
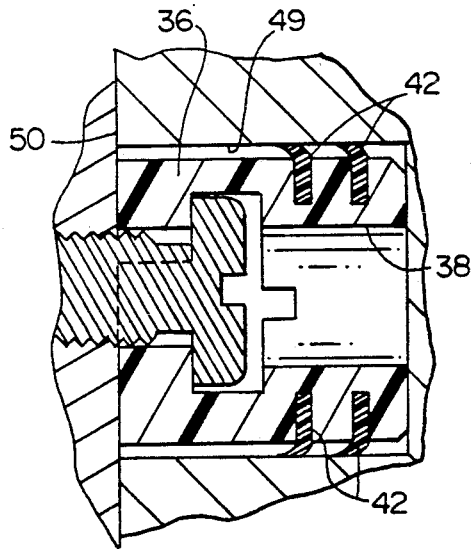
FIG. 11 is a vertical section of the FIG. 7 in place in a cavity in the rear edge of a shelf with the shelf mounted against a wall.
Figure 10:
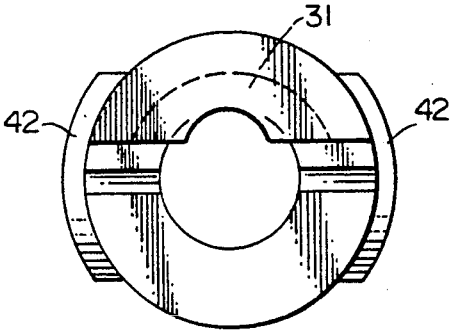
FIG. 10 is an end view of the bushing of FIG. 7.

Each cavity 49 on a rear edge 50 of a shelf 51 into which one of the bushings 30 is inserted should have a diameter about one-sixteenth of an inch greater than the diameter of the body of the bushing 30, so that there is a clearance of about one-thirtysecond of an inch between the wall of the cavity 49 and the outside surface of the bushing 30. Since the fins 42 project about one-sixteenth of an inch from the body of the bushing 30 they are bent backwardly as shown in FIG. 11 when the bushing 30 is thrust into the cavity 49. The flexible fins 42 should be somewhat stiff to act in the manner of barbs which make it impossible to pull the bushing 30 out of the cavity 49 once it is thrust into place. Glue may be applied around and about the fins 42 to aid in this anchoring effect but glue is by no means necessary and the mechanical barb action alone is capable of anchoring each bushing in its respective cavity.

Aside from the use of the fins 40 rather than the glue-filled groove 11 the second embodiment of FIGS. 7 to 13 is the same as the first embodiment of FIGS. 1 to 6, the bore 38 being a minor difference which as noted is dictated only by the method of extrusion of the plastic bushing 30.

It is to be understood that the word "shelf" as used herein is to mean any article intended to be affixed to a vertical wall and the word "wall" is intended to means any vertical supporting surface. The mounting means of the invention is capable of use in various environments and combinations and the preferred embodiment herein described may be modified within the scope of the invention as expressed in the following claims.

I claim:

1. Mounting means in combination with a shelf on a vertical wall for releasably securing said shelf horizontally to said vertical wall comprising a) said shelf having a vertical rear edge surface and horizontally extending upper and lower surfaces, said rear edge surface having formed with a cavity extending horizontally into said shelf through said rear edge surface, said cavity being spaced from said upper and lower surfaces b) a bushing having an outer configuration received fully and in a close fit within said cavity, c) means on the exterior of the bushing anchoring the bushing in the cavity, d) a screw having a head and shank portion adapted to project substantially horizontally from the wall, and e) a seat end on the bushing fitting over and behind an upper edge portion of the head projecting form the wall thereby resisting straight-line horizontal displacement of the bushing from the screw head and therefore of the shelf from the wall, f) the rear edge of the shelf adapted to be mounted flush against the wall with the bushing concealed and the shelf being removable by lifting the bushing from the screw head and horizontally displacing the shelf way from the wall.

* * * * *